United States Patent [19]

Bagley

[11] 3,941,378

[45] Mar. 2, 1976

[54] CONVERTIBLE POOL-DINING TABLE WITH RETRACTABLE BALL BOX

[75] Inventor: Stuart C. Bagley, Glen Ellyn, Ill.

[73] Assignee: Armac Enterprises, Inc., Chicago, Ill.

[22] Filed: Jan. 20, 1975

[21] Appl. No.: 542,364

[52] U.S. Cl. ..... 273/5 R; 273/3 C; 273/12; 312/300

[51] Int. Cl.[2] ..... A63D 15/04

[58] Field of Search ..... 273/5 R, 5 A, 5 B, 5 C, 273/11 R, 11 C, 12, 3 C, 123 R; 312/300; 292/76, 87; 220/306, 307

[56] References Cited

UNITED STATES PATENTS

| | | | |
|---|---|---|---|
| 572,688 | 12/1896 | Seifert | 273/5 R |
| 888,966 | 5/1908 | Dewey | 312/300 X |
| 936,406 | 10/1909 | Brown | 312/300 X |
| 1,345,194 | 6/1920 | Johnson | 312/300 X |
| 1,463,845 | 8/1923 | Ryan | 273/11 R |
| 1,539,296 | 5/1925 | Bundy et al. | 312/300 X |
| 1,540,316 | 6/1925 | Clement | 273/5 C |
| 3,711,099 | 1/1973 | Milu | 273/123 R |
| 3,871,655 | 3/1975 | Zimmers et al. | 273/5 R X |

FOREIGN PATENTS OR APPLICATIONS

| | | | |
|---|---|---|---|
| 2,142,236 | 4/1972 | Germany | 220/306 |

*Primary Examiner*—Anton O. Oechsle
*Assistant Examiner*—Richard T. Stouffer
*Attorney, Agent, or Firm*—Hill, Gross, Simpson, Van Santen, Steadman, Chiara & Simpson

[57] ABSTRACT

A convertible table structure for a bumper pool game, particularly a convertible table structure at which persons may be seated for dining or other purposes, and in which tray members are provided for collecting playing balls passing through apertures in the playing surface of the bumper pool game, adjacent the periphery of the latter, wherein the ball trays are pivotally supported from the table structure with the tray member disposed at the underside of the table top in open communication with and directly below the cooperable ball aperture, the respective tray members being pivotally movable from a closed position closely adjacent to the underside of the table top and the adjacent, peripheral edge of the latter. The peripheral edges of the table top defining the bumper pool game playing surface are provided with recesses in their lower face cooperable with the tray members for receiving and retaining playing balls in a storage position when the table is to be used for purposes other than the bumper pool game, with each tray being so disposed, when it is in closed position, that it does not materially add to the overall thickness of the table top and thus will not interfere with adequate leg and knee room for occupants seated at the table.

19 Claims, 6 Drawing Figures

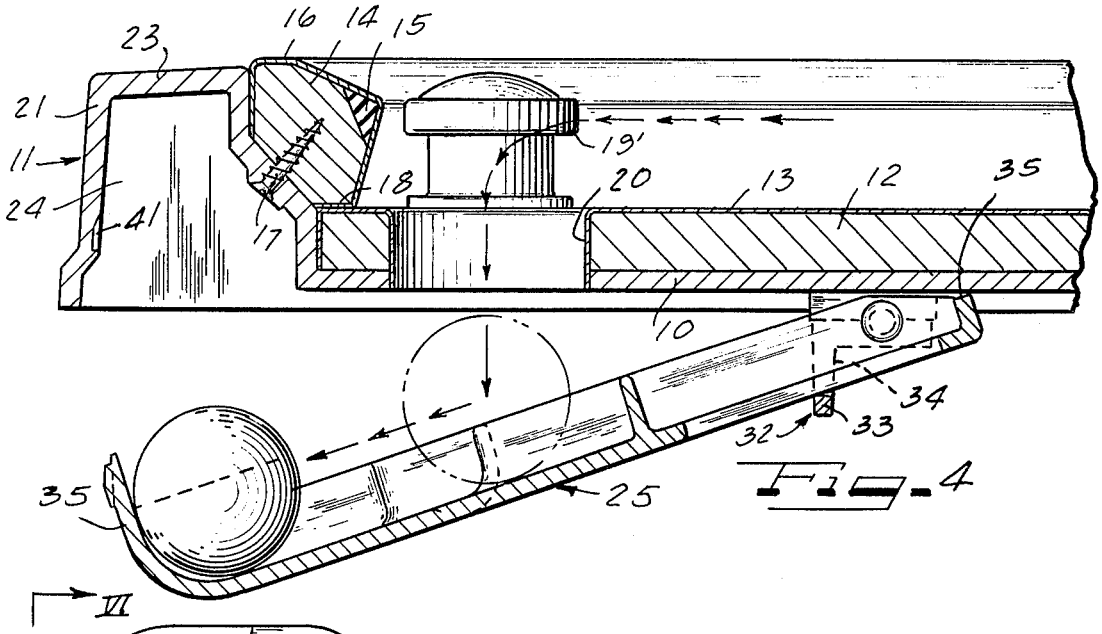
Fig. 4
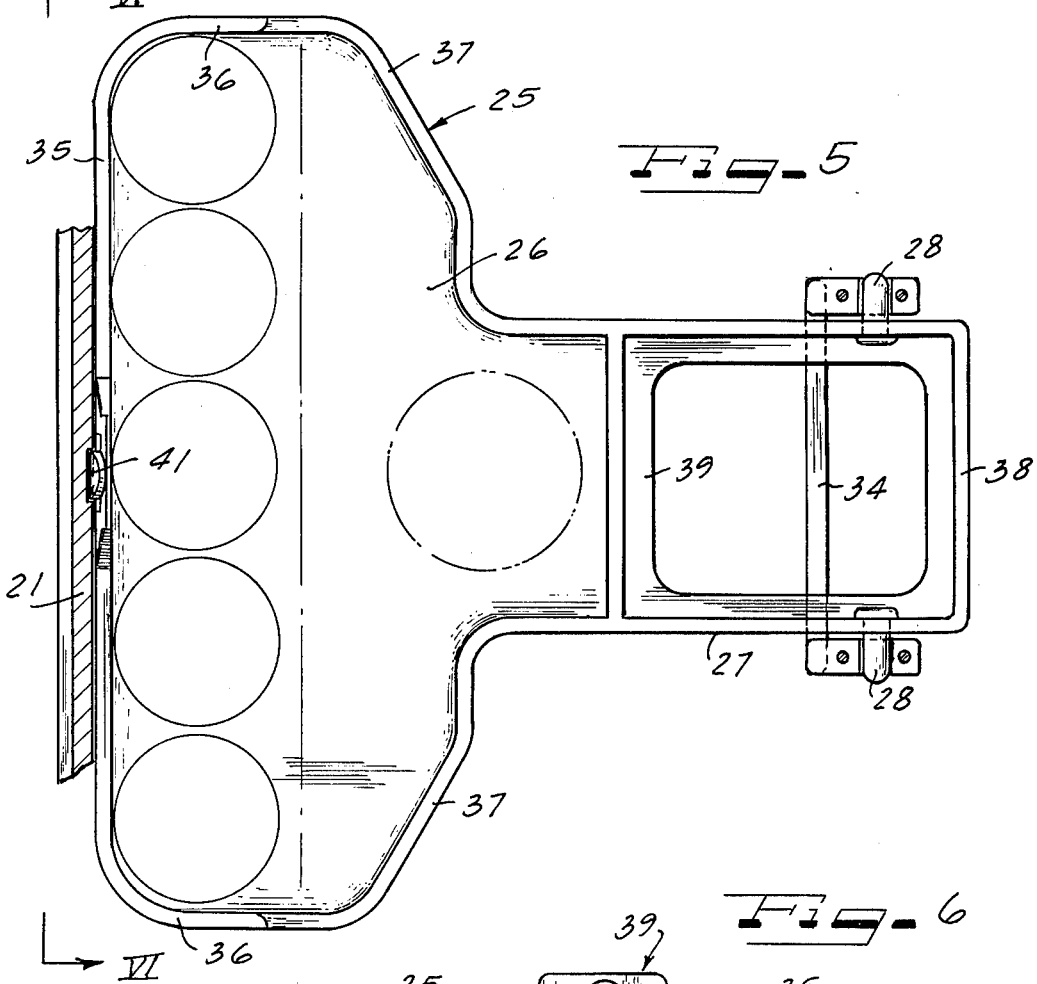
Fig. 5
Fig. 6
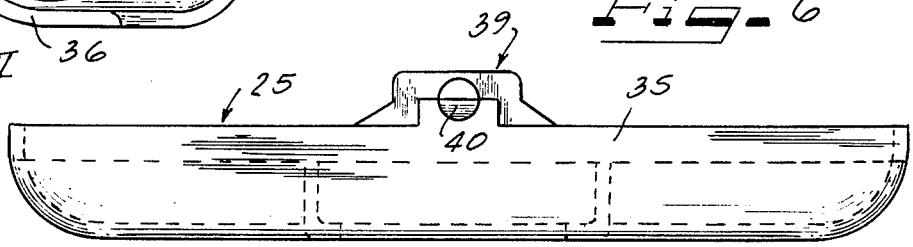

CONVERTIBLE POOL-DINING TABLE WITH RETRACTABLE BALL BOX

BACKGROUND OF THE INVENTION

Bumper pool tables as well as convertible tables which may be used for playing bumper pool, or card games, or provided with a flat top surface for use as dining room table, desk or the like, are known in the art. An example of a typical table of this type is illustrated in Milu U.S. Pat. No. 3,711,099, which illustrates a bumper pool game table which employs a separate reversible top structure which may be disposed and supported by the bumper pool table structure to provide, in one position, a flat surfaced dining room table top or the like, or reversed to provide a card game playing top having recesses for receiving glasses, chips, etc.

The bumper pool game table is provided with a pair of ball receiving apertures in a playing surface thereof whereby a ball entering such aperture may drop through the table top and be received in a ball collection box. As the ball apertures are disposed adjacent the peripheral edges of the table, and the ball boxes disposed directly therebelow, they would if left in such positions interfere with the seating of a person at the table, as such boxes extend down to a point where they would interfere with the normal positioning of a seated person's legs and knees. The patentee solved the problem by making such ball collection boxes detachable whereby they could be completely removed from the table. While this solved the initial problem of providing adequate leg space below the table when the bumper pool game is not in use, it has the disadvantage that the ball collection boxes and balls therein may be disposed at a remote location relative to the table itself, with possible loss, etc.

BRIEF SUMMARY OF THE INVENTION

The invention is therefore directed to a table construction in which the ball retaining means is a permanent part of the table and is not detached therefrom, the construction and location of the ball retaining means being such that it may be moved from an operative open position, facilitating removal of balls therefrom during play on the bumper pool table, to a closed position directly below the top thereof, with the peripheral edge portions of the table top being provided with recesses therein, opening on the bottom face thereof, and adapted to cooperate with the ball retaining means, whereby such balls are at least partially disposed within such recesses in the table top.

Such construction enables the disposition of the ball retaining means closely adjacent to the table top structure, in particular, adjacent a peripheral edge of the table and as such retaining means may be made very shallow, the projection of the ball retaining means below the edge of the table top is inconsequential, insofar as use of the table for other purposes, such means being disposed completely out of the way of persons seated at the table, so that no interference with the leg room thereunder is created. Consequently, the playing balls for the bumper pool game are retained at all times directly with or "in" the table, greatly eliminating the possibility of loss of balls and eliminating the use of removable ball retaining means and possible misplacement or loss thereof as well. The bumper pool game structure thus is completely self-contained with the playing balls always readily available for use.

BRIEF DESCRIPTION OF THE DRAWINGS

In the drawings wherein like reference characters indicate like or corresponding parts.

FIG. 4 is a sectional view similar to FIG. 3 with the ball-retaining tray in open position to provide access to the balls contained or received therein following their passage through a ball aperture;

FIG. 5 is a top plan view of the tray structure illustrated in FIGS. 2–4 with a portion of the table illustrated in section to disclose details of the means for maintaining the tray in closed position, such as illustrated in FIG. 3; and FIG. 6 is a front elevational view of the tray illustrated in FIG. 5, taken approximately on the line VI—VI of FIG. 5.

DETAILED DESCRIPTION OF THE INVENTION

General Construction

Figure 1:
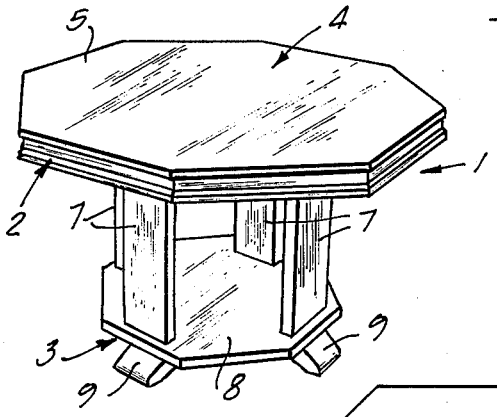
FIG. 1 is a perspective view of a convertible table embodying the invention.
Figure 2:
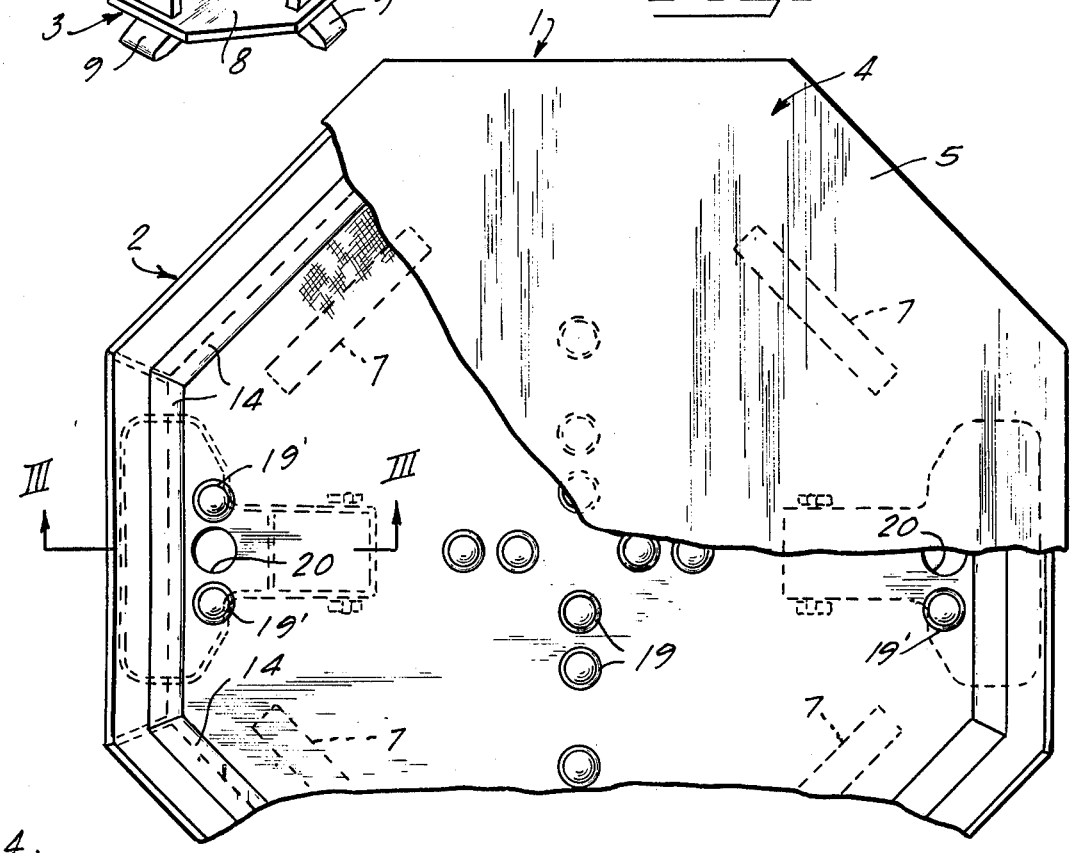
FIG. 2 is a top plan view of a portion of the table illustrated in FIG. 1 with the upper top member broken away to show details of the bumper pool playing surface.
Figure 3:
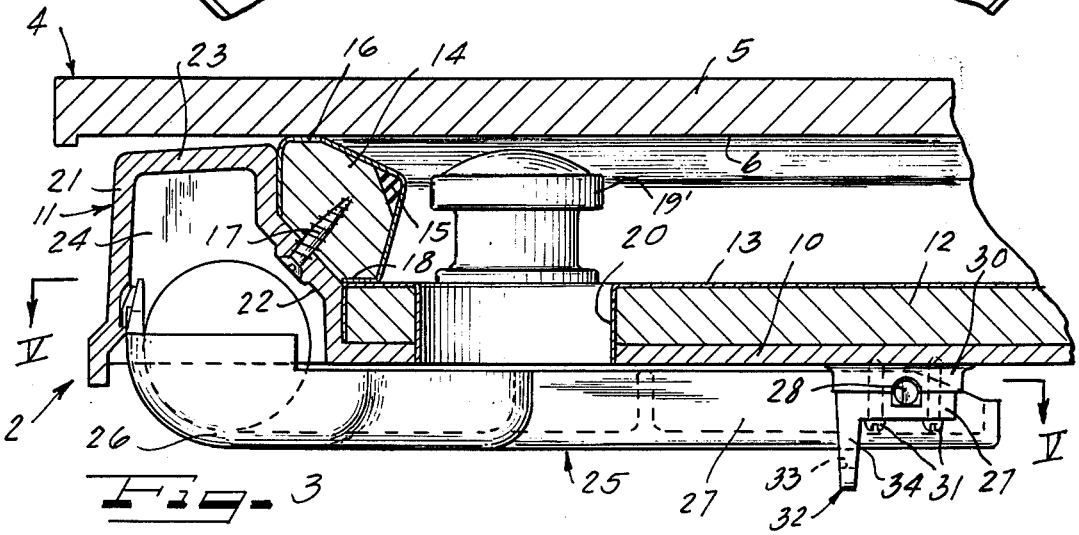
FIG. 3 is a sectional view taken approximately on the line III—III of FIG. 2, with the ball-retaining tray in closed or ball-storing position.

Referring to the drawings and more particularly to FIGS. 1–3, the reference numeral 1 indicates generally a convertible game table having a table top, indicated generally by the numeral 2, which is connected to and supported by suitable means, for example, a leg assembly indicated generally by the numeral 3. An additional separate top member, indicated generally by the numeral 4, which may be supported by the table top 2, is provided with a flat upper face 5 whereby it may be used for the same purposes as an ordinary table, i.e. dining, etc.

Preferably the underside 6 of the top 4 may be suitably configured to provide a card game top such as that illustrated in the Milu patent heretofore referred to, which type of top, being quite old in the art and not forming a part of the invention, has not been illustrated.

The supporting structure 3 may be of any suitable design and configuration, that illustrated comprising a plurality of legs 7, four such legs being employed in the construction of FIG. 1, with the legs suitably secured at their upper ends to the top 2 by any suitable means, for example the usual type mounting cleats and the like to which the legs may be screwed or otherwise attached.

In the embodiment of FIG. 1 the legs 7 terminate at and are rigidly secured to a shelf member 8, which in turn has depending cleats or feet 9 suitably secured to the shelf 8 to form a unitary rigid supporting structure for the table 2. Details of the supporting structure form no part of the present invention and may assume widely diverging designs. Thus, in lieu of the structure illustrated in FIG. 1, four legs could readily be employed, comparable to the average four-legged table, or a central pedestal could be employed, the particular design utilized being solely a matter of choice.

As illustrated in FIGS. 2 and 3, the bumper pool game table top 2 is provided with a bottom wall 10 having peripheral side walls, indicated generally by the reference numeral 11, extending upwardly from the peripheral edges of the bottom wall 10, the bottom 10 and side walls 11, in the embodiment of the invention illustrated, being suitably formed as a unitary structure for example by means of a molding operation with the actual bumper pool playing surface being formed by a planar member 12 which is seated upon the bottom 10 and supported thereby. The member 12 may be of any suitable material, for example such as associated with other ball games, i.e. pool or billiard games, preferably an inexpensive material that will adequately retain its flat upper surface which may be covered with the usual cloth 13 of the type used on pool tables.

The playing area of the game is defined by respective bumper members 14 have a resilient corner portion 15, for example of rubber or other suitable material, with the bumper being covered with material 16 generally corresponding to the cover material 13. The respective bumper members 14 are secured to the table structure by any suitable means, as for example, screws 17 passing through a portion of the peripheral side wall structure and extending into the bumper member 14 which, for example, may be made of wood or other suitable material. In the construction illustrated, the bumper members 14 are adapted to overlie the peripheral portions of the member 12 as indicated at 18, thereby simultaneously securing the member 12 in fixed relation with respect to the bottom wall 10. The respective bumper members may be suitably mitered at their abutting ends in accordance with standard pool table fabrication or the like.

The playing surface of the bumper pool table is provided with a plurality of upwardly extending bumper posts or members 19 which are illustrated as being symmetrically arranged at the central portion of the table in correspondence to standard bumper pool arrangement, and likewise the playing surface is provided with a pair of ball receiving pockets or apertures 20 disposed at opposite sides of the table, with each aperture 20 being spaced a short distance from the adjacent bumper member 14 and protected by a pair of bumper posts 19' corresponding in construction to the posts 19.

The ball retaining means

As illustrated in FIG. 3, the peripheral sidewalls 11 of the bumper pool game table 2 are of a generally inverted U-shape configuration having a downwardly depending outer wall 21, a downwardly depending inner wall 22 and a connecting top wall 23 to define a longitudinally extending recess 24 along each section of the sidewall structure which opens on the bottom thereof.

Disposed directly below the ball aperture 20 is a ball receiving and retaining tray member, indicated generally by the numeral 25, which in the embodiment illustrated is of a generally T-shape configuration, having a cross portion 26 adapted to extend in the same direction as the adjacent sidewall 21 of the table top and a transversely extending leg portion 27, which in the embodiment illustrated is provided with a pair of trunnions 28 which are retained in axially fixed relation by a pair of trunnion blocks 29, each mounted on a cooperable block 30 integrally formed with and secured to the bottom wall 10 of the table top structure. As illustrated in FIG. 3, the respective trunnion blocks 29 are fastened to the associated cooperable block 30 by suitable means, such as screws 31, and the respective blocks 29 are connected by a bail member 32 having a horizontally extending portion 33 which terminates at its respective ends in an upwardly extending connecting member 34, which in the embodiment illustrated is integrally formed with the associated block 29. The ball retaining tray 25 thus may be moved from an upper closed position, such as illustrated in FIG. 3 to a lower open position illustrated in FIG. 4, in which movement the tray pivots about the axis of the trunnions.

As illustrated in FIG. 4, the extreme end of the leg portion 27 of the tray may be provided with an upwardly extending abutment 35, which may suitably engage a portion or part of the bottom wall 10 of the table structure. The tray member may be thus retained in its open position by engagement both with the cross member 34 and with the bottom wall 10.

As illustrated in FIGS. 3–6, the cross member 26 of the tray 25 is provided with a front wall 35 and associated sidewalls 36 having a height slightly greater than the diameter of the balls to be supported therein and further side and rear wall portions 37 which are illustrated as being of lesser height than the front wall 35, and end walls 36. The leg portion 27 of the tray member is formed by a continuation of the sidewalls 37, and cooperable end walls 38, both of which are formed with horizontally extending bottom flange portions 39, whereby the respective structural members forming the portion 27 are angle members.

The front wall 35 of the each tray member is provided with an upwardly extending projection 39 which carries a laterally outwardly extending detent member 40, adapted to cooperate with a notch 41 disposed in the inner face of the outer wall 21 of the peripheral sidewall 11. Thus, when the tray member is in its upper or closed position, as illustrated in FIG. 3, the detent member 40 will latch in the recess 41 and normally retain the tray member in such closed position. However, by applying manual separating forces between the outer wall 21 of the sidewall and the adjacent portion of the wall 35 of the tray member, relative movement of the latter with respect to the notch 41 may be effected to release the detent member 40 from the notch and permit the tray member to pivot about the axis of the trunnions 28 into its open position, as illustrated in FIG. 4. In such position of the tray member, balls may pass through the aperture 20 as indicated in broken lines in FIG. 4 and roll down the inclined bottom wall to position, illustrated in solid lines, with the spacing between the top edge of the front wall 35 of the tray member and the bottom edge of the outer wall 21 being sufficiently greater than the diameter of the balls to enable removal from the tray member.

The embodiment of the invention illustrated in FIG. 5, is adapted to be employed with a standard bumper pool game utilizing 10 playing balls, for example 5 for each player and the lateral length of the cross portion 26 of the tray member along the peripheral sidewall 11 thus has a dimension sufficient to accommodate 5 balls along the front wall 35, whereby the two tray members will accommodate all of the playing ball. Likewise, the recess 24 in the sidewall 11 has a length at least adequate to receive the 5 balls carried by the tray member whereby the two tray members form ball-storage receptacles when the bumper pool game is not in use. In the present instance where the peripheral sidewall 11 is of hollow molded construction, adequate space will automatically be provided therein to accommodate the desired number of balls.

It will be particularly noted that the construction of the tray member and sidewall structure of the table completely eliminates the necessity of removing the ball collection means when the table is employed for other purposes and the bumper pool game thus is not in use. By utilizing a shallow tray member such as the tray member 25, in combination with the recessed sidewall structure of the table top, as will be apparent from reference to FIG. 3, the tray member extends below the free edge of the outer wall 21 only an immaterially short distance whereby the closed tray member offers no interference to a person seated at the table. Likewise, as it is therefore unnecessary to remove the ball retaining means from the table top to a location remote therefrom, for example detaching the ball retaining means from the table top as is done in the Milu patent previous referred to, the present invention eliminates the possibility of the balls and the retaining means therefor being lost or mislaid as a result of their separation from the table top. The balls are therefore retained with the table top at all times and are always immediately available for use when desired.

As illustrated in FIGS. 3 and 4, the bumper members 14 may have their top walls 16 elevated above the top or intermediate wall 23 of the peripheral sidewalls, so that the top of the bumper members may function as a support for the table top, preventing scratching or other damage to the top wall 23 of the peripheral sidewalls of the table by frictional engagement with the added table top.

It will be appreciated from the above description that the present invention provides a very simple yet highly effective table top structure having ball retaining means which is so designed that, in cooperation with the peripheral sidewall of the table structure provides storage means for the game balls employed with the bumper pool game table top when the latter is not in use.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. In a bumper pool game table structure, including a plurality of playing balls, a generally horizontal table top member and a structure for supporting said top member in operative position, particularly a convertible table structure in which persons may be seated thereat, for dining or other purposes, the combination of said top member having a horizontally extending planar playing surface bounded by upwardly extending peripheral side walls, at the inner sides of which are disposed bumper members defining the operative periphery of the playing area, said playing surface having a plurality of bumper posts disposed thereon in predetermined relation, and having at least one ball-receiving aperture extending through the top member adjacent a peripheral edge of the table, a relatively shallow generally flat tray member, disposed below said aperture, and adapted to retain a plurality of said playing balls of said bumper pool game, said balls being of such a size in relationship to the depth of said tray member that when said balls are retained in said tray member, their upper portions extend above the peripheral edges of the tray member, the latter being supported by said table structure for selective movement from a first generally horizontal position in which said tray member is disposed closely adjacent the underside of said top member, with the laterally outer portion of the tray member disposed directly below the adjacent peripheral side wall of the table top, to a second ball return position, in which balls passing through said aperture will be received in said tray and may move to said laterally outer portion, with the latter portion of the tray member disposed in downwardly spaced relation with respect to the adjacent peripheral side wall of the table top a distance greater than the diameter of the playing balls to provide access between said side wall and the tray member to balls so received in the latter, said adjacent peripheral side wall of the table top having a recess therein opening on and extending upwardly from said underside of said top member, said recess being of a size and configuration and said tray member being so positioned relative thereto and to said underside of said top member such that the upper portions of said balls, when disposed in said laterally outer portion of the tray member, are positioned above said underside of said top member and in said recess when the tray member is in said first position, thus providing storage of said balls in said tray member and said recess whereby said tray member, when in said first position, while disposed adjacent the peripheral edge of the table top, is at a height at which it will not interfere with adequate leg and knee room for occupants seated at the table.

2. A game table structure according to claim 1, wherein said playing surface is provided with two of said ball apertures respectively positioned adjacent oppositely disposed bumper members, and a pair of said ball tray members, each cooperably disposed with respect to a corresponding aperture and adjacent peripheral side wall, each of which is provided with a cooperable recess, the laterally outer portions of the two tray members and cooperable recesses having respective lengths that all playing balls of the bumper pool game may be stored therein when said tray members are in their closed positions and the bumper pool game is not in use.

3. A game table structure according to claim 2, wherein each tray member is pivotally carried by said table top for movement about a horizontal axis extending parallel to the direction of the cooperable peripheral sidewall of the table top.

4. A game table structure according to claim 1, wherein the peripheral sidewall of said table top is of molded plastic construction and of inverted U-shape in transverse cross-section.

5. A game table structure according to claim 1, wherein the laterally outermost wall of said tray member, when the latter is in closed position, extends into the cooperable recess in the peripheral sidewall and is provided with detent means cooperable with means on the face of the outer wall of said recess, for releasably retaining the associated tray member in its closed up position, and adapted to release the tray member by the application of separating forces to the cooperable detent means on the tray member and cooperable recess wall.

6. A game table structure according to claim 1, wherein said tray member is of generally T-shape in plan configuration with said laterally outer portion forming the cross member of the T in the inner portion thereof forming the leg of the T, said pivotal axis being disposed adjacent the free end of such leg.

7. A game table structure according to claim 1, comprising in further combination an abutment rigidly carried by said table top disposed in the path of said tray member whereby downward pivotal movement of the latter is limited by said abutment.

8. A game table structure according to claim 1, wherein said tray member is provided with an abutment thereon disposed for engagement with the bottom of said table top to limit downward movement of the tray member to open position.

9. A game table structure according to claim 1, wherein said tray member is provided with aligned oppositely disposed integrally formed trunnion members pivotally supported in respective trunnion blocks carried by the table top, said trunnion blocks being connected by a member carrying a tray restricting abutment.

10. A game table structure according to claim 1, wherein said tray members are each constructed as a unitary plastic structure.

11. A game table structure according to claim 1, wherein said table top comprises a unitary plastic top base member including said peripheral sidewalls, and a planar member supported by said base which forms the game playing surface.

12. A game table structure according to claim 1, wherein said playing surface is bounded by respective bumper members carried by the respective sidewalls, said bumper members extending above the intermediate wall portion of the associated sidewall, forming resilient supporting means for an additional table top adapted to be supported thereon.

13. A game table structure according to claim 1, wherein said playing surface is provided with two of said ball apertures respectively positioned adjacent oppositely disposed bumper members, and a pair of said ball tray members, each of which is pivotally carried by said table top for movement about a horizontal axis extending parallel to the direction of the cooperable peripheral sidewall of the table top and cooperably disposed with respect to a corresponding aperture and adjacent peripheral sidewall, each of the latter being provided with a cooperable recess, the laterally outer portions of the two tray members and cooperable recesses having respective lengths that all playing balls of the bumper pool game may be stored therein when said tray members are in their closed positions and the bumper pool game is not in use, the peripheral sidewall of said table top being of molded plastic construction and of inverted U-shape in transverse cross-section, the laterally outermost wall of said tray member, when the latter is in closed position, extending into the cooperable recess in the peripheral sidewall and provided with detent means cooperable with means on the face of the outer wall of said recess, for releasably retaining the associated tray member in its closed up position, and adapted to release the tray member by the application of separating forces to the cooperable detent means on the tray member and cooperable recess wall.

14. A game table structure according to claim 13, wherein said tray member is of generally T-shape in plan configuration with said laterally outer portion forming the cross member of the T in the inner portion thereof forming the leg of the T, said pivotal axis being disposed adjacent the free end of such leg.

15. A game table structure according to claim 1, wherein said tray member is provided with aligned oppositely disposed integrally formed trunnion members pivotally supported in respective trunnion blocks carried by the table top, an abutment rigidly carried by and connecting said trunnion block disposed in the path of said tray member whereby downward pivotal movement of the latter is limited by said abutment.

16. A game table structure according to claim 15, wherein said tray member is provided with an abutment thereon disposed for engagement with the bottom of said table top to limit downward movement of the tray member to open position.

17. A game table structure according to claim 16, wherein said tray members are each constructed as a unitary plastic structure.

18. A game table structure according to claim 17, wherein said table top comprises a unitary plastic top base member including said peripheral side walls, and a planar member supported by said base which forms the game playing surface.

19. A game table structure according to claim 1, wherein said playing surface is bounded by respective bumper members carried by the respective sidewalls, said bumper members extending above the intermediate wall portion of the associated sidewall, forming resilient supporting means for an additional table top adapted to be supported thereon.

* * * * *